United States Patent [19]

Lowther

[11] 4,355,965

[45] Oct. 26, 1982

[54] ROTARY SLIDING VANE DEVICE WITH RADIAL BIAS CONTROL

[75] Inventor: Frank E. Lowther, Buffalo, N.Y.

[73] Assignee: Atlantic Richfield Company, Los Angeles, Calif.

[21] Appl. No.: 118,397

[22] Filed: Feb. 4, 1980

[51] Int. Cl.[3] ..... F01C 19/08; F01C 21/04; F04C 18/00; F04C 29/02

[52] U.S. Cl. ..... 418/111; 418/268

[58] Field of Search ..... 418/111, 267, 268, 223, 418/236, 238, 265

[56] References Cited

U.S. PATENT DOCUMENTS

| | | | |
|---|---|---|---|
| 706,158 | 8/1902 | Charles | 418/111 |
| 825,374 | 7/1906 | Black | 418/267 |
| 1,898,914 | 2/1933 | Vickers | 418/267 |
| 2,831,631 | 4/1958 | Petersen | 418/267 |
| 3,086,475 | 4/1963 | Rosaen | 418/268 |
| 3,765,379 | 10/1973 | Thomas | 418/267 |
| 3,781,145 | 12/1973 | Wilcox | 418/268 |

FOREIGN PATENT DOCUMENTS

| | | | |
|---|---|---|---|
| 1503595 | 7/1969 | Fed. Rep. of Germany | 418/268 |
| 794773 | 5/1958 | United Kingdom | 418/267 |

*Primary Examiner*—John J. Vrablik

*Attorney, Agent, or Firm*—Drude Faulconer

[57] ABSTRACT

A rotary sliding vane fluid device with sealing and lubrication between the vanes, rotor, and stator. Each vane comprises a pair of elements having longitudinal and axial passages therethrough for supplying lubricating and sealing fluid to the tip and axial end portions of the vane. A port in the rotor to lower end of the vane slot provides fluid pressure to bias the vane and supplies fluid to the longitudinal vane passage.

1 Claim, 10 Drawing Figures

ROTARY SLIDING VANE DEVICE WITH RADIAL BIAS CONTROL

BACKGROUND OF THE INVENTION

The subject matter is rotary sliding vane devices such as are used as air compressors or motors.

Rotary sliding vane devices are known to the prior art and are commonly used as compressors, hydraulic pumps, and air motors. Such devices typically consist of a rotor rotatably mounted and eccentrically disposed within a stationary casing, with radial vanes slidably inserted in rotor slots to extend against the inner periphery of the casing. Efficient operation of such devices depends, among other things, on effective sealing between the moving vanes and the stationary casing.

The present invention is directed particularly toward a solution to the sealing problem at the axial ends of the rotor vanes where centrifugal force is not a factor and does not aid in creating a seal between the stationary and moving parts. The object of this invention is therefore to provide a rotary sliding vane device with enhanced lubrication and sealing between rotor and stator to thereby enhance its operation as a positive displacement fluid device. This is accomplished by providing a mechanical bias of the members against the casing and further providing a film of air to lubricate the vanes at their interface with the stator casing.

The details, operation, and benefits of the present invention will now be described more specifically with reference to the accompanying drawing.

DRAWING

DESCRIPTION

Figure 1:
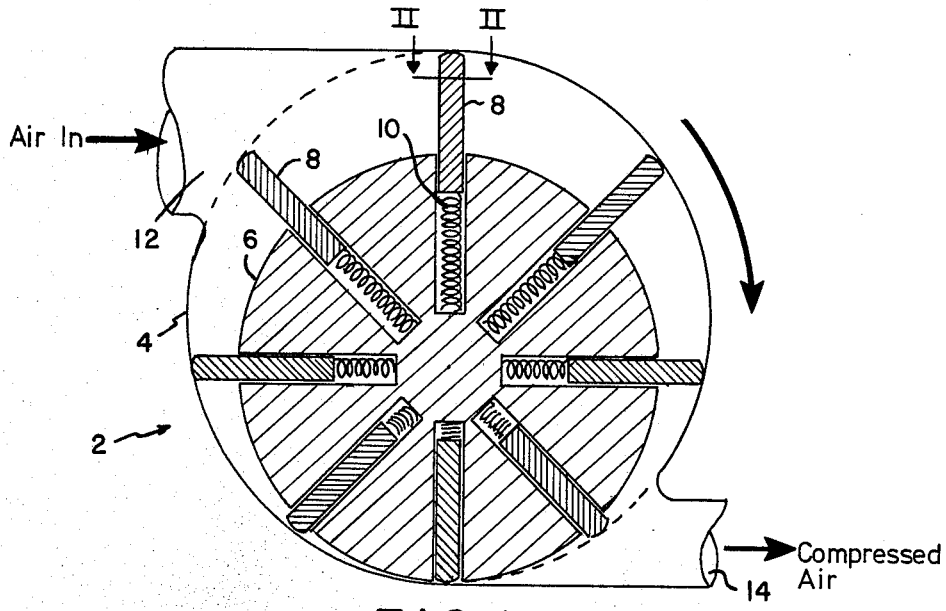
FIG. 1 is a somewhat schematic diagram, looking in an axial direction at the interior of a rotary sliding vane device.

Referring now to FIG. 1, a rotary sliding vane device is generally indicated at 2 and includes a casing 4 in which is rotatably mounted a rotor 6. Rotor 6 includes a plurality of radially slidable vane members 8 and some means, generally represented by springs 10, to control the radial position of the vanes 8 and their biasing force against the stator or casing 4.

Casing 4 includes a fluid inlet passage 12 and a fluid outlet passage 14, such as would be for the inlet and outlet of air in the case of a compressor. If the device were to be used as a motor, then the inlet and outlet passages are reversed. The interior of casing 4 is shown to be circular in cross section. At the axial ends of the casing, not shown in FIG. 1, the casing typically includes a plane end plate at each end of the rotor axis. As will be apparent, the rotating rotor 6 and vanes 8 preferably move in close contact with the casing 4 to form a seal therewith to prevent or minimize a loss of fluid between vanes and casing.

Figure 2:
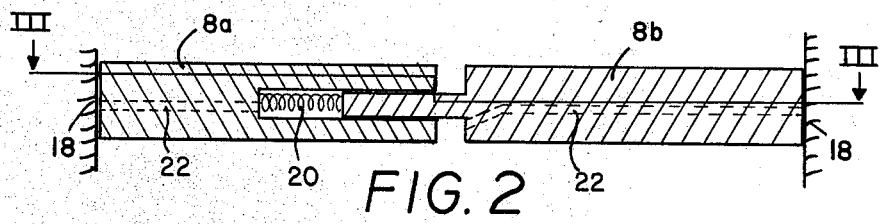
FIG. 2 is a view of one vane member as indicated by the arrows II in FIG. 1.

FIG. 2 represents a single rotor vane and its co-action with the end plates 18 of the casing. Vane 8 includes a pair of interlocking elements 8*a* and 8*b* with one or more compression springs 20 disposed therebetween to urge the members 8*a* and 8*b* apart and into a positive contact with the end plates 18. The vane members 8*a* and 8*b* include a plurality of air or gas ports 22 to convey lubricating gas or air to the peripheral areas where the vanes and casing co-act.

Figure 4:
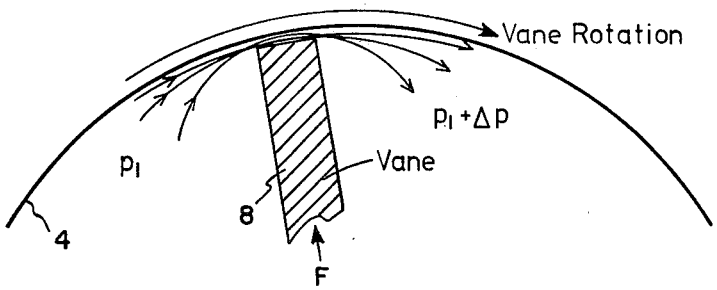
FIGS. 4–8 are diagrams of variations of end configurations of the vane members showing their relationship to the stator and showing the movement of air relative thereto.
Figure 5:
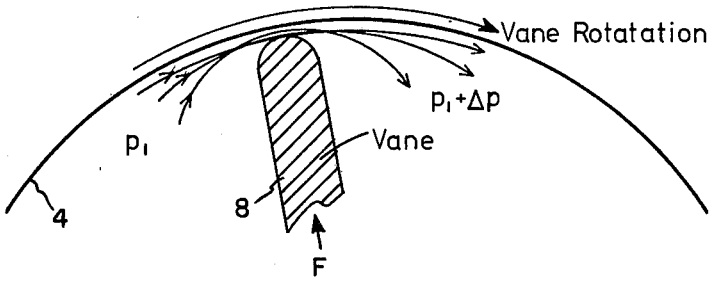
Figure 6:
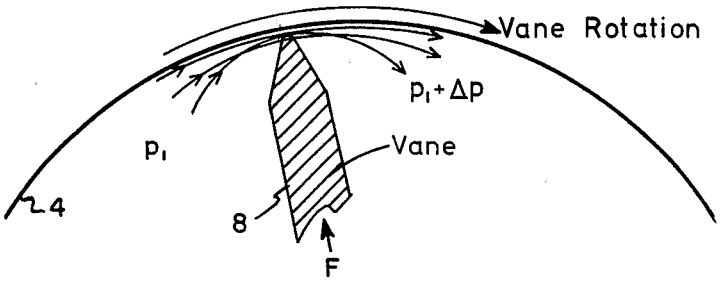
Figure 7:
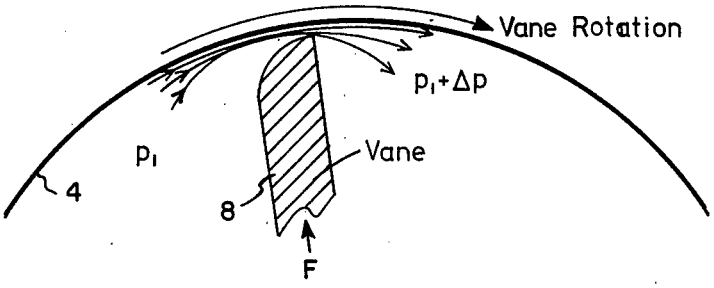

The considerations of vane wear and lubrication are addressed by allowing the vane tip and the axial vane ends to ride on a cushion of air in the area where they co-act with the casing 4. FIG. 4 shows an edge on view of a vane 8 and the leakage path. The driving pressure, $\Delta_p$, depends not only upon total compression ratio but also upon the number of vanes. The important factor is pressure difference across a given vane. FIGS. 5, 6, and 7 gives a positive picture of the effect of the shape of the vane tips. Tip speeds are low enough that aerodynamic forces tending to push the vane inward are small in relation to the $\Delta_p$ represented in the figures, and such aerodynamic forces may be disregarded. In FIGS. 4, 5, 6, and 7, the basic idea is to control the force, F, tending to extend the vane so as to allow just enough leakage around the vane tips to lubricate the vane at the pressure desired. Thus, the vane never actually touches or rubs against the casing and the vane wear and lubrication problems are solved.

Figure 10:
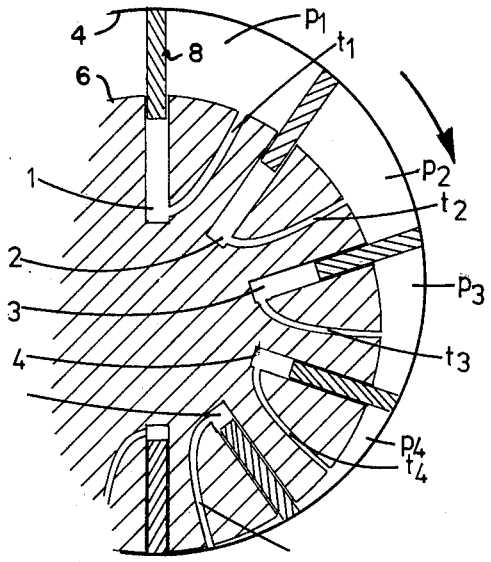
FIG. 10 is a sectional view of another embodiment of the rotary sliding vane device of the present invention.

The vane force, F, must be greater when the vane is near the inlet port. That is to say, $\Delta_p$ in FIG. 4 is nearly zero at the inlet port and reaches a maximum value when the vane is near the outlet port. The vane force, F, may be varied as a function of rotation angle of the rotor and one automatic means to achieve this is shown in FIG. 10. Each compression cavity has a capillary tube leading to the base of a sliding vane. In effect, the product air supplies pressure to push the vane outwardly. In FIG. 10, the pressure $p_1$ is low and therefore applies little force to the base of the vane 8. On the other hand, pressure $p_3$ is relatively high and supplies a large force to the base of vane 8 prime. Check valves and vents may be required in the various channels. It may also be desirable to have a given capillary tube feed the base of the vane ahead instead of the vane behind. It may also be desirable to feed a vane two cells ahead or behind, and so on.

Figure 8:
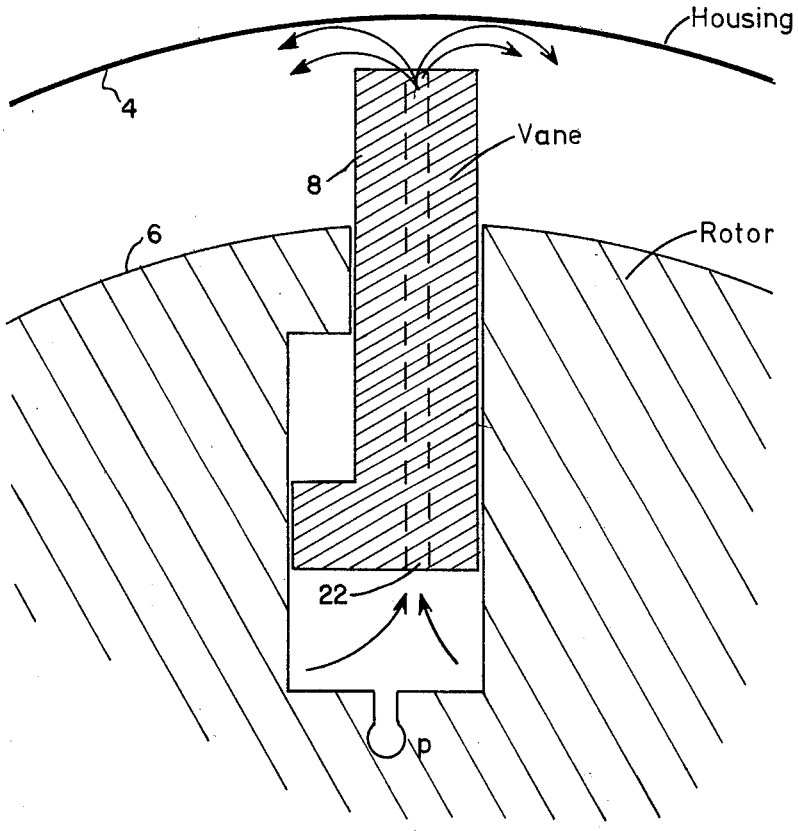
Figure 9:
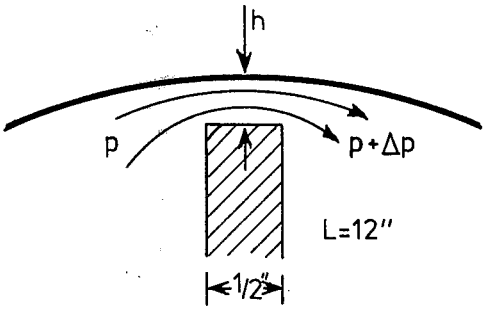
FIG. 9 is a plot of leakage rate against film thickness between moving vane and the stator casing.
Figure 9:
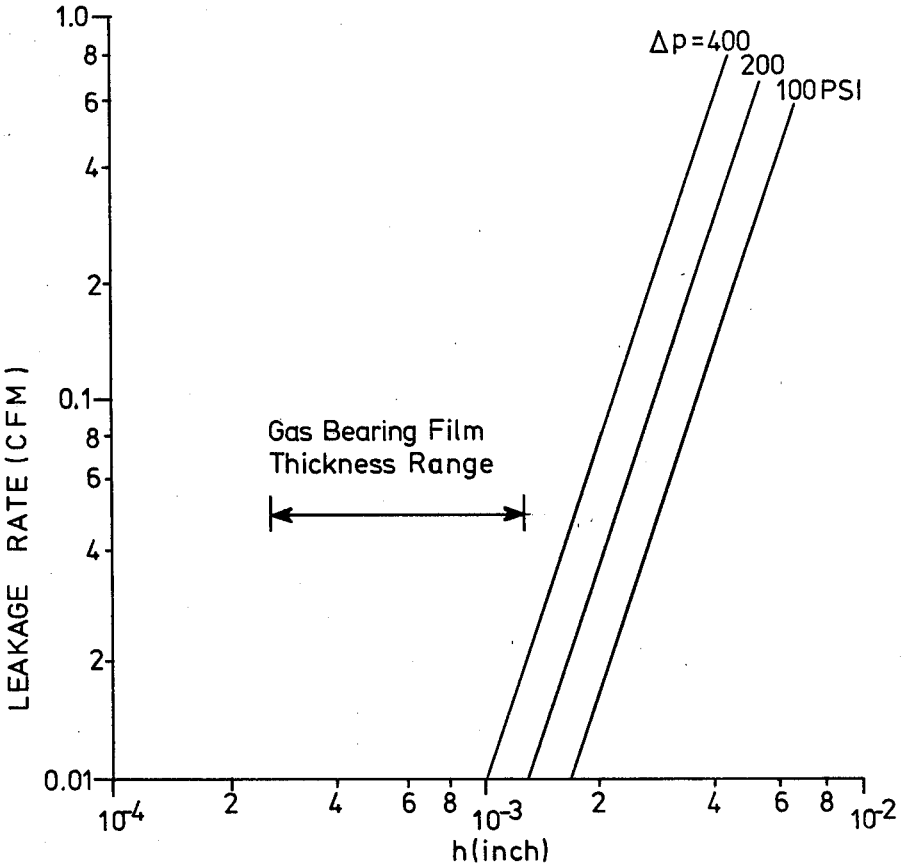

FIG. 8 shows another vane air lubrication embodiment. In this case, passages in the vane allow some of the control air, p, to leak up around the vane tip as shown. This is similar to a classic gas air puck arrangement. The air leakage rate is calculated in Appendix 1 hereto and the results plotted in FIG. 9 for the typical case shown. A typical application would find a total flow of several hundred SCFM. Thus, several CFM leakage can be easily tolerated. Since standing gas bearing technology calls for films of less than 0.001 inch, clearly the present proposed gas lubrication techniques will cost only an insignificant amount of the product air.

Figure 3:
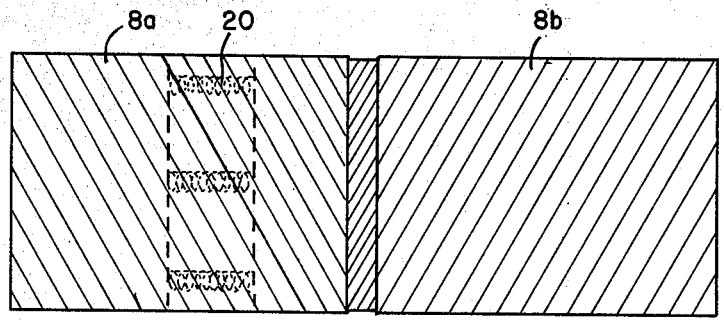
FIG. 3 is a sectional view of the vane member of FIG. 2 taken along lines III—III of FIG. 2.

Now, with respect to air leakage around the axial ends of the vanes, the split vane 8*a* and 8*b* exemplified in FIGS. 2 and 3 is urged against the end plates. In addition, vane member 8*a* and 8*b* are ported to conduct product air to the axial ends as well as to the radial tips as shown.

The foregoing specification has described several configurations of sliding vanes for the purpose of lubricating and sealing the rotary vanes relative to their stationary casing. The disclosed embodiments are exemplary and are not intended as exhaustive of the possibilities. The scope of the invention is accordingly limited only by the purview of the following claims.

APPENDIX I

If we assume the vane-housing gap to be an approximately rectangular channel, we may write [1]:

$$\Delta_p = 1.44 \times 10^{-3} \frac{L}{wh^3} \dot{W} \quad 1.$$

$\Delta_p$=Pressure Difference Across Vane (psi)
W=Leakage Rate (lbs./sec.)
L=Axial Length of Vane
W=Vane Thickness
h=Vane−Casing Clearance The equation has been corrected to 600° F.

Gas bearing technology indicates the gas film thickness[2] to be in the range of $3\times10^{-4}$ to $8.8\times10^{-4}$ inch. It now becomes possible to estimate order of magnitude leakage rates if this lubrication technique is applied. This result is plotted in FIG. 9.

Reference for Appendix I

1. "Fluidics Components and Circuits," Foster and Parker, Wiley-Interscience, 1970, pg. 49–50.

2. "Gas Film Technology," W. A. Gross, John Wiley & Sons, 1962, pg. 271.

What is claimed is:

1. A rotary sliding vane fluid device comprising:

a casing having a chamber;

a rotor disposed for rotation within said chamber;

a vane slidably mounted in a slot within said rotor and extending outward toward the interior wall of said chamber and disposed for outward and inward movement relative to said rotor in response to rotation thereof, said vane having a longitudinal passage therethrough, said vane further comprising:

a pair of interlocking elements, each of said pair of interlocking elements is ported to permit fluid flow therethrough to the axial end portions thereof to supply a lubricating film of fluid at said ends of said vane;

means disposed between said interlocking elements to bias said interlocking elements apart and toward the side walls of said chamber; and a port in said rotor extending from said the lower end of said slot to the surface of said rotor at a point forward of said vane to permit flow of fluid from said chamber to beneath the lower end of said vane whereby the pressure of said fluid within said chamber is applied to said vane to vary the bias of said vane against said chamber as said rotor rotates within said chamber and to supply fluid through said longitudinal passage in said vane to provide a lubricating film of fluid to the tip regions of said vane.

* * * * *